US007594597B2

(12) United States Patent
Uchikoshi

(10) Patent No.: US 7,594,597 B2
(45) Date of Patent: Sep. 29, 2009

(54) METHOD FOR TENSIONING SIDE PORTIONS OF SHIRT AND BODY TENSIONING DEVICE APPLIED FOR THE METHOD

(75) Inventor: Mitsuyuki Uchikoshi, Tokyo (JP)

(73) Assignee: San Kousha Engineering Co., Ltd. (JP)

( * ) Notice: Subject to any disclaimer, the term of this patent is extended or adjusted under 35 U.S.C. 154(b) by 120 days.

(21) Appl. No.: 11/850,060

(22) Filed: Sep. 5, 2007

(65) Prior Publication Data

US 2008/0011790 A1 Jan. 17, 2008

(51) Int. Cl.
*D06F 71/20* (2006.01)
*D06F 71/16* (2006.01)

(52) U.S. Cl. ..... 223/70; 223/73

(58) Field of Classification Search ..... 223/66–71; 38/14–16

See application file for complete search history.

(56) References Cited

U.S. PATENT DOCUMENTS

| | | | | |
|---|---|---|---|---|
| 3,273,765 | A * | 9/1966 | Piilola | 223/57 |
| 3,473,709 | A * | 10/1969 | Carpenter | 223/57 |
| 4,728,015 | A * | 3/1988 | Holzapfel et al. | 223/70 |
| 5,722,572 | A * | 3/1998 | Pessina | 223/70 |
| 7,370,778 | B1 * | 5/2008 | Uchikoshi | 223/70 |
| 7,438,205 | B2 * | 10/2008 | Uchikoshi | 223/73 |

* cited by examiner

*Primary Examiner*—Ismael Izaguirre
(74) *Attorney, Agent, or Firm*—Andrus, Sceales, Starke & Sawall, LLP

(57) ABSTRACT

A shirt side tension applying method is provided for finishing side portions of a shirt. The method includes the step of providing a first tension applying process in which side pressing members at both portions of a dummy having the shirt put thereon are extended up to positions by a driving device after which the side portions of the shirt are tensioned with the side pressing members inclined by their own weight. The method also includes a second tensioning applying process in which, when the front and rear portions of the shirt are pressed, the same driving device operates again to cause the side pressing members to be further extended and the side portions of the shirt are finished in tension. The invention further contemplates a body tensioning device for finishing the side portions of the shirt according to the method described above.

6 Claims, 6 Drawing Sheets

METHOD FOR TENSIONING SIDE PORTIONS OF SHIRT AND BODY TENSIONING DEVICE APPLIED FOR THE METHOD

BACKGROUND OF INVENTION

1. Field of Invention

This invention relates to a method for tensioning the side portions of shirt. More particularly, this invention relates to a method for applying tension against the side portions of the shirt to make a neat press finishing state and a body tensioning device used for this method in a shirt press finishing machine for press finishing the shirt of a laundry item with a pair of front and rear press irons while the shirt is being put on the dummy.

2. Description of Related Art

As this type of prior art device, there is provided a device disclosed in the gazette of U.S. Pat. No. 6,868,996, for example. This prior art device is formed to have the side pressing members arranged vertically at both sides of the dummy and a driving device for protruding the side pressing members.

It is further well known in the art that the size of shirts such as white shirts or the like is normally classified into large, middle and small sizes, respectively. Accordingly, it is desired in this type of device that the device is constituted in such a way that the shirt can be finished easily, positively and neatly in its tensioned state even if the sizes of the shirts are different from each other.

In view of the foregoing, this type of prior art device has been provided with three types of switches set in such a way that an extension distance of the side pressing members is made different for every size, a worker has judged the size of the shirts, depressed the switch in compliance with the size to finish the side portions in tension.

Accordingly, this type of prior art device has been operated in compliance with a sensitive feeling of the operator, so that the operator has happened to mistake the size of the shirts and it has been frequently found that a manual correction of the shirt with an iron after mechanical finishing has been carried out.

In addition, since it was necessary for the operator to judge the size of the shirts in order to depress the switch corresponding to each of the sizes, it could not be avoided that a working efficiency was decreased.

SUMMARY OF INVENTION

This invention has been invented in view of the aforesaid prior art problems.

Accordingly, the technical matter of this invention is to provide a method for applying tension to side portions of shirt and a body tension applying device used for the method formed in such a way that a troublesome work for an operator to judge a size of shirt and measure a tension applying distance of the side pressing members can be eliminated and the side portions of the shirt can be finished in tension easily, positively and neatly.

In order to resolve this problem, this invention is constituted as follows.

That is, as shown in FIGS. 1 and 4 or the like, the tension applying method of this invention finishes the side portions of shirt through a first tension applying process in which the side pressing members arranged vertically at both sides of a dummy having the shirt installed thereon are extended by a driving device for extending the side pressing members up to the position where the side pressing members incline by their own weights to the side portions of the dummy, and a second tension applying process in which, upon pressing against the front and rear portions of the shirt, the driving device is operated again to extend further the side pressing members and finish in tension the side portions of the shirt.

In addition, as shown in FIGS. 1 to 3 or the like, the device of this invention used for the tension applying method is constituted by the side pressing members arranged vertically at both sides of a dummy having a shirt put on there, a driving device for extending the side pressing members, and a controller for controlling the driving device to cause the side pressing members to perform the first tension applying process and the second tension applying process.

Since this invention is constructed as described above, this invention does not require any selection of extending distance of the sided pressing members in compliance with a size of shirts. Thus, in accordance with this invention, the sides of shirt put on the dummy can be finished in tension in an easy, positive and neat manner without being influenced by an operator's judgment.

In this invention, the driving device is realized by an air cylinder or a motor, for example. In addition, as the controller, a micro-computer or a sequencer, for example, can be applied.

In addition, it is preferable in this invention that the driving device is installed at a lower inside part of the dummy. A reason for it consists in the fact that an opening area at each of the sides of the dummy can be made narrower as compared with that of arranging the driving device outside the dummy and it is possible to prevent hot air and steam supplied into the dummy from being leaked out of the side portions of the dummy.

In addition, as shown in FIG. 1 and the like, it is preferable in this invention that the lower part of a raised supporting member for use in supporting the side pressing members is bent from a position of a pivoting shaft for this supporting member toward inside of the dummy and a rod of an air cylinder acting as the driving device is pivoted at the lower end of the bent part.

In accordance with this invention, a reason why this system is preferable consists in the fact that the bent formation of the lower part of the supporting member facilitates a storing of the air cylinder acting as the driving device within the dummy.

Further, in this case, as shown in FIG. 5, it is preferable in the present invention that the air cylinder acting as the driving device is arranged to be raised at the central part of the lower portion of the dummy in a lateral direction with its rod being set upright and the right and left side.

Additionally, in this case, since one unit of the driving device is present, the side pressing members can be easily synchronized and parts cost and manufacturing cost can be reduced. In addition, in this case, one unit of the driving device enables a vacant space of the lower part of the dummy to be increased and hot air and steam supplied into the dummy not to be disturbed.

Further, as shown in FIG. 6, it is also preferable in this invention that the driving device is an air cylinder and a pair of air cylinders are installed within the barrel part of the dummy with their rods being laterally arranged toward the sides of the dummy.

In this case, the side pressing members can be controlled at a near distance and so less-expensive air cylinder with a low capability can be used. In addition, in accordance with this invention, since the driving device is placed at a high position, a shirt can be finished fast and neat state without disturbing hot air and steam supplied into the dummy.

DESCRIPTION OF PREFERRED EMBODIMENTS

Referring now to the accompanying drawings, some preferred embodiments of the present invention will be described as follows.

Figure 1:
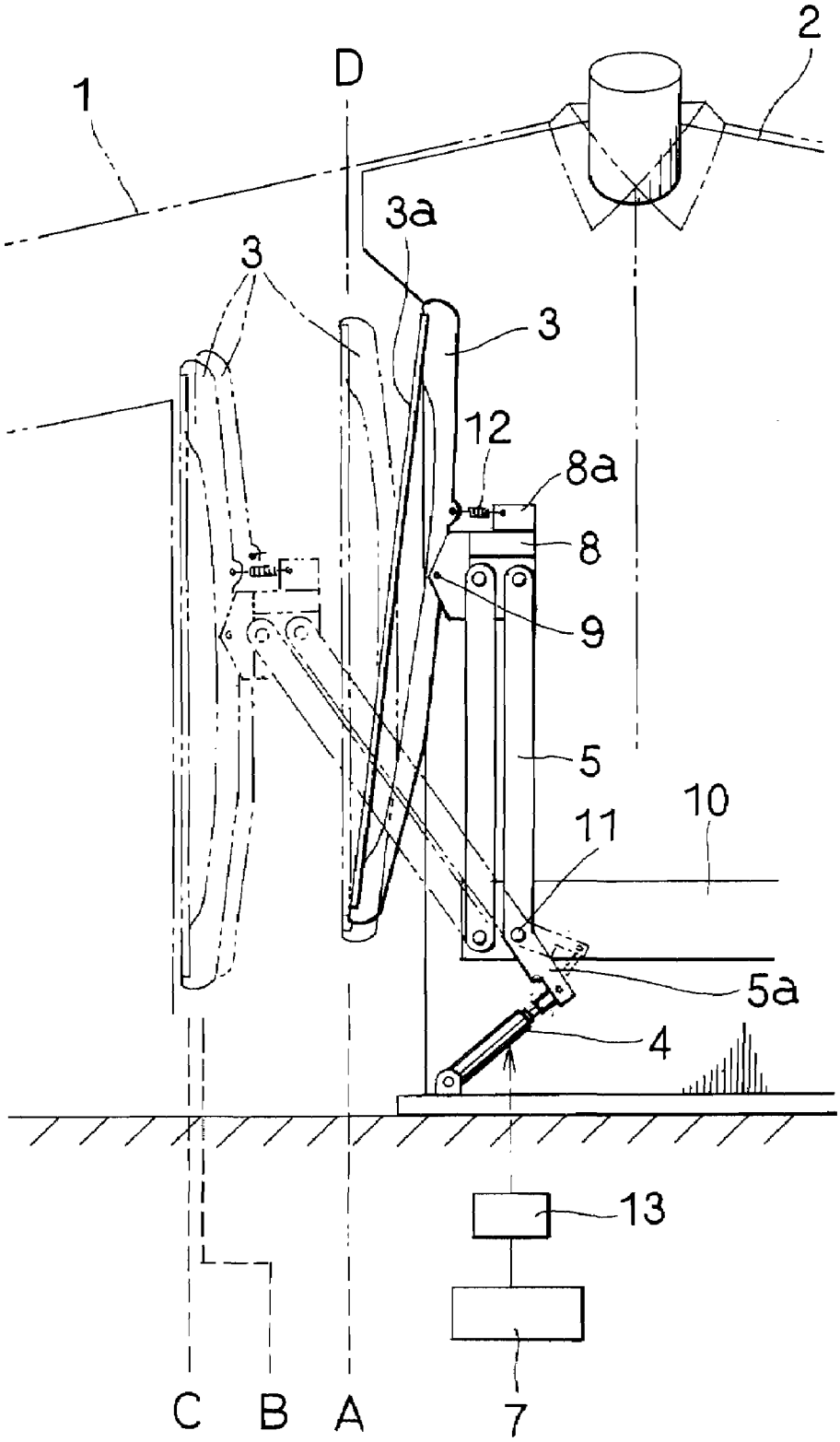
FIG. 1 is a substantial front elevational view for showing one preferred embodiment of the present invention with a part being broken away.

In FIG. 1 and the like, reference numeral 1 denotes a shirt such as a white shirt. Reference numeral 2 denotes a dummy on which this shirt 1 is put. Reference numeral 3 denotes side pressing members arranged vertically at both sides of the dummy 2. In addition, reference numeral 4 denotes a driving device for protruding the side pressing members 3 toward the side portions of the dummy 2.

A tension applying method of this invention finishes the side portions of a shirt 1 through a first tension applying process (a position B in FIG. 1) for extending side pressing members 3 up to the positions with the aforesaid driving device 4 where the side pressing members incline toward the side portions of a dummy 2 with their own weight (a position A in FIG. 1) and a second tension applying process.(a position C in FIG. 1) where the driving device 4 is driven again upon pressing against the front side and rear side of the shirt 1 to cause the side portions of the shirt 1 to be finished in tension.

The aforesaid side pressing members 3 are extended from their first positions (refer to the solid line states in FIGS. 1 and 3) to the side portions of the dummy 2 by the driving device 4. Then, the side pressing members 3 incline by their own weight from the position slightly exceeding the vertical line (D in FIG. 1). The driving device 4 stops its driving action when the side pressing members 3 reach up to the positions where they incline by their own weight. In the case of this preferred embodiment, the driving device 4 is constituted by an air cylinder. Accordingly, an extending action of the rod in the air cylinder stops and an extracting of the rod becomes free. As a result, the side pressing members 3 incline toward the side portions of the dummy 2 by their own weight to press against the side portions of the shirt 1 and stop. With this operation, the side portions of the shirt 1 are tensioned to perform a first tension applying process.

In this case, the side pressing members 3 apply tension against the side portions of the shirt 1 in compliance with its size. That is, when the size of the shirt 1 is large, the shirt is tensioned under a state in which an inclination angle of the raised supporting member 5 supporting the side pressing member 3 is large, and in turn when the size of the shirt 1 is small, the shirt is tensioned under a state in which an inclination angle of the raised supporting member 5 is small. Further, in this case, the shirt 1 does not show any disturbed state at its front side because the shirt 1 is adsorbed at the surface of the dummy 2. In addition, it is also applicable that the shirt 1 has some buttons applied in place of adsorption to prevent the front side disturbance from being occurred.

Then, the present invention is operated such that when the press irons 6 (refer to FIG. 2) press against the front and rear portions of the shirt 1, the driving device 4 operates again to cause the side pressing members 3 to be further extended toward the side portions of the dummy 2. With this operation, the second tension applying process is carried out for the shirt 1 under a state in which its front and rear portions are pressed with press irons 6. Further, in the case of the shirt press finishing machine shown in FIG. 2, the front side press iron 6 is formed such that it can be slid in the rightward or leftward direction.

Then, upon completion of the pressing work with the press irons 6 and releasing of the press irons 6 from the front and rear portions of the dummy 2, the driving device 4 oppositely drives them. As a result, the side pressing members 3 return, the front and rear portions of the shirt 1 are press finished and at the same time the side portions of the shirt are finished in tension.

Then, the body tensioning device used for the method for applying tension of the present invention will be described as follows.

Figure 2:
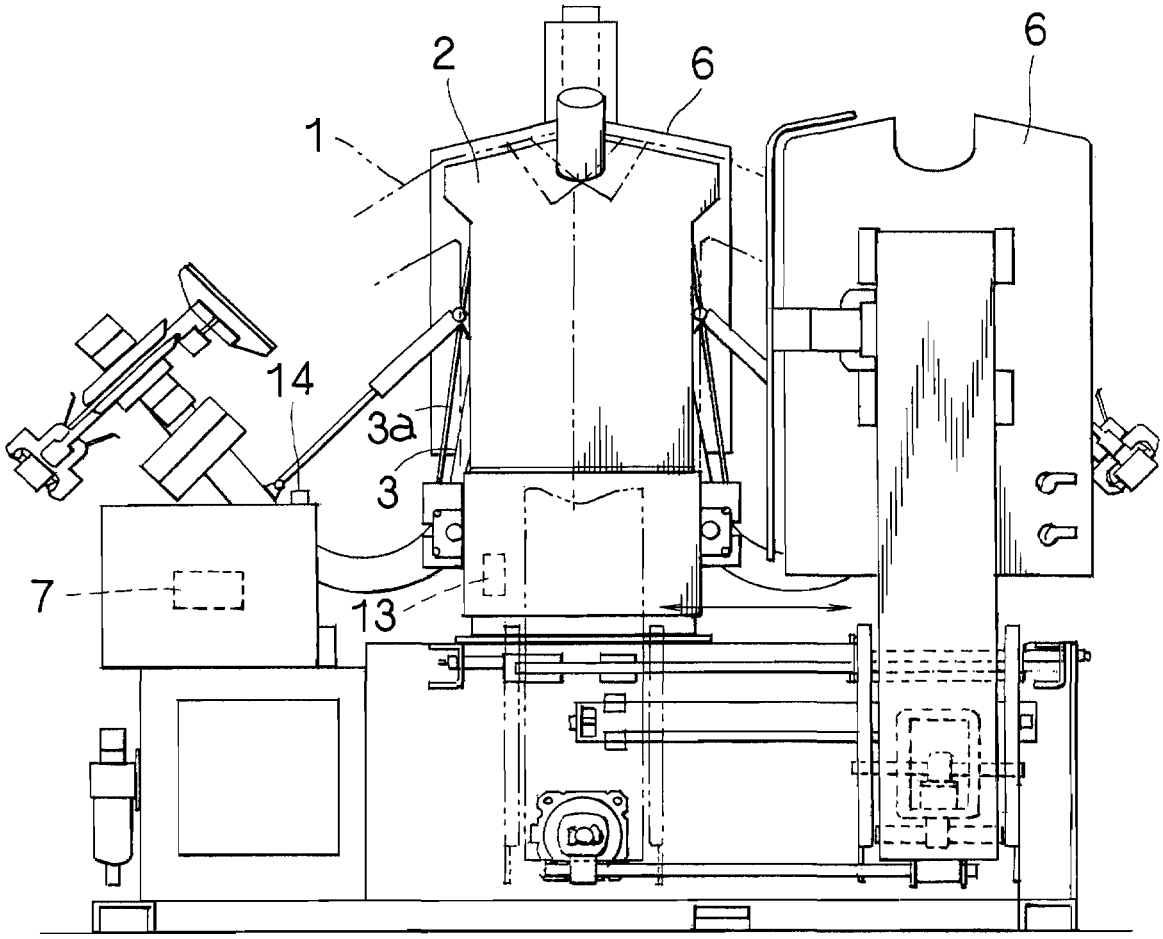
FIG. 2 is a front elevational view for showing a shirt press finishing machine provided with the device of the present invention.
Figure 3:
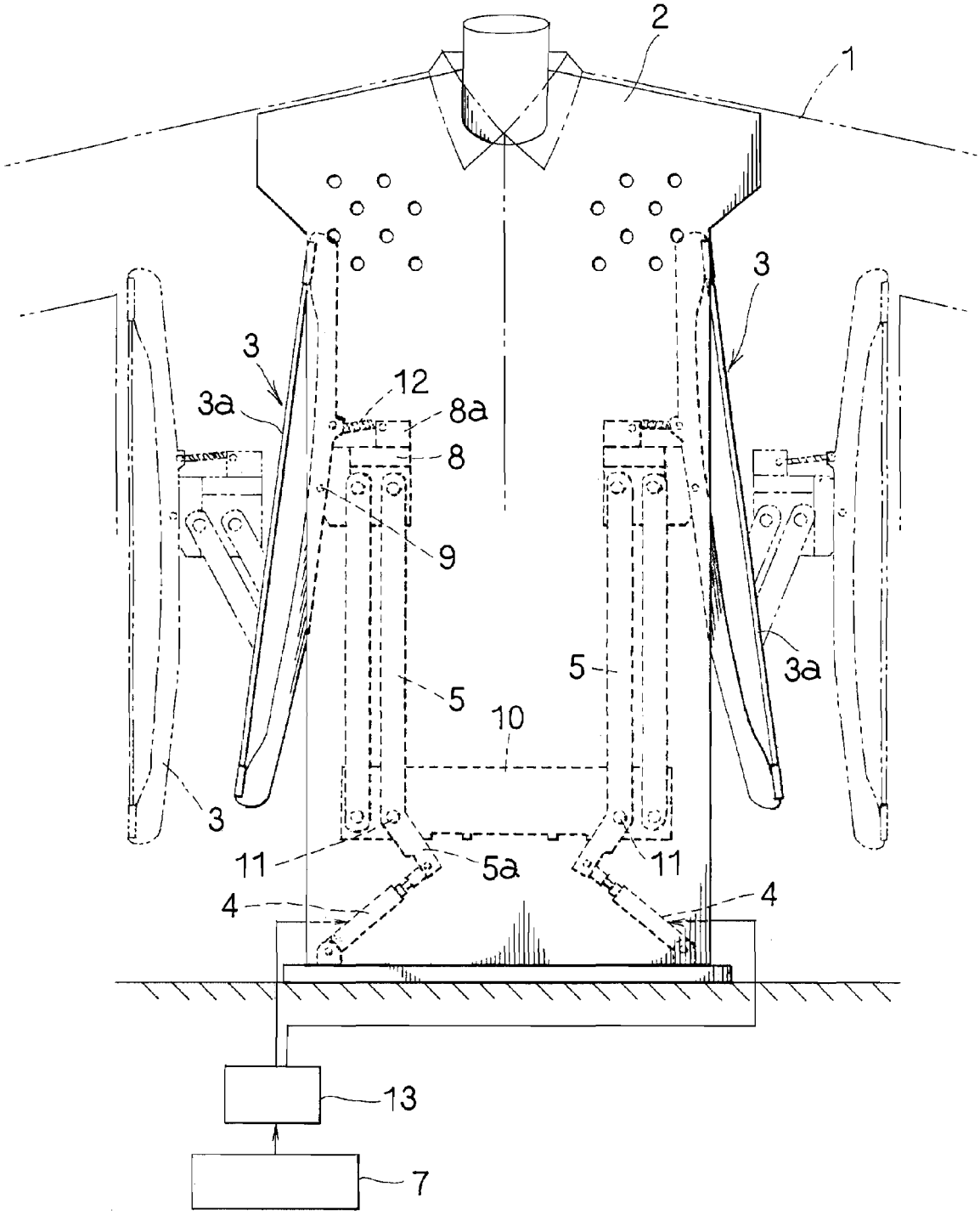
FIG. 3 is a substantial front elevational view for showing the device of the present invention.

As shown in FIGS. 1 to 3, the device of the present invention is formed to have side pressing members 3 arranged vertically at both sides of the dummy 2 on which the shirt 1 is put, the driving device 4 for protruding in tension the side pressing members 3, and a controller 7 for controlling the driving device 4 to cause the side pressing members 3 to perform the first tensioning process and the second tensioning process.

The aforesaid side pressing members 3 are formed in a bow-like shape with the concave surfaces being faced toward the side portions of the dummy 2. Then, the side pressing members 3 are made such that flexible wire members **3*a* applied to the inner surfaces of the side portions of the shirt 1 are tensioned in arcuate manner at upper and lower ends. The wire members 3*a*** in this preferred embodiment are constituted by fine coil springs.

The upper ends of the supporting members 5 supporting the side pressing members 3 are pivoted at substantial central positions of the side pressing members 3 through a connecting plate 8. Reference numeral 9 denotes a pivot pin arranged horizontally along a forward or rearward direction of the dummy 2. The side pressing members 3 turn by a predetermined angle around the pivot pin in a lateral direction of the dummy 2. In addition, the lower part of the supporting member 5 is pivoted to a fixing part 10 in the dummy 2 through a shaft 11.

In addition, the present invention in this preferred embodiment is set such that a raised piece **8*a* is raised at the upper part inside the connecting plate 8. Then, the upper end of the raised piece 8*a* and an outer edge position at the corresponding back side of the side pressing member 3 are connected with a tension spring 12. This tension spring 12 is used for facilitating a returning of the side pressing members 3 when the side pressing members 3 are inclined around the pivot pin 9 with the curved lines of the side portions of the shirt 1. Further, the side pressing members 3 are normally covered with a cover (not shown) together with the dummy 2**.

As the aforesaid driving device 4 in this preferred embodiment, an air cylinder is used and the driving device is arranged in an inclined state inside the lower part of the dummy 2 with its rod being faced inwardly. The lower part of the raised supporting member 5 supporting the side pressing members 3 is bent inwardly of the dummy 2 from the shaft 11. The rod of the air cylinder acting as the driving device 4 is pivoted to the lower end of this bent part 5*a*.

The aforesaid controller 7 is constituted by a micro-computer, for example. This controller 7 has a program for carrying out the aforesaid first tension applying process and the second tension applying process. Then, this controller 7 is electrically connected with a solenoid valve 13 for controlling a flow passage of air for the air cylinder acting as the driving device 4.

Figure 4:
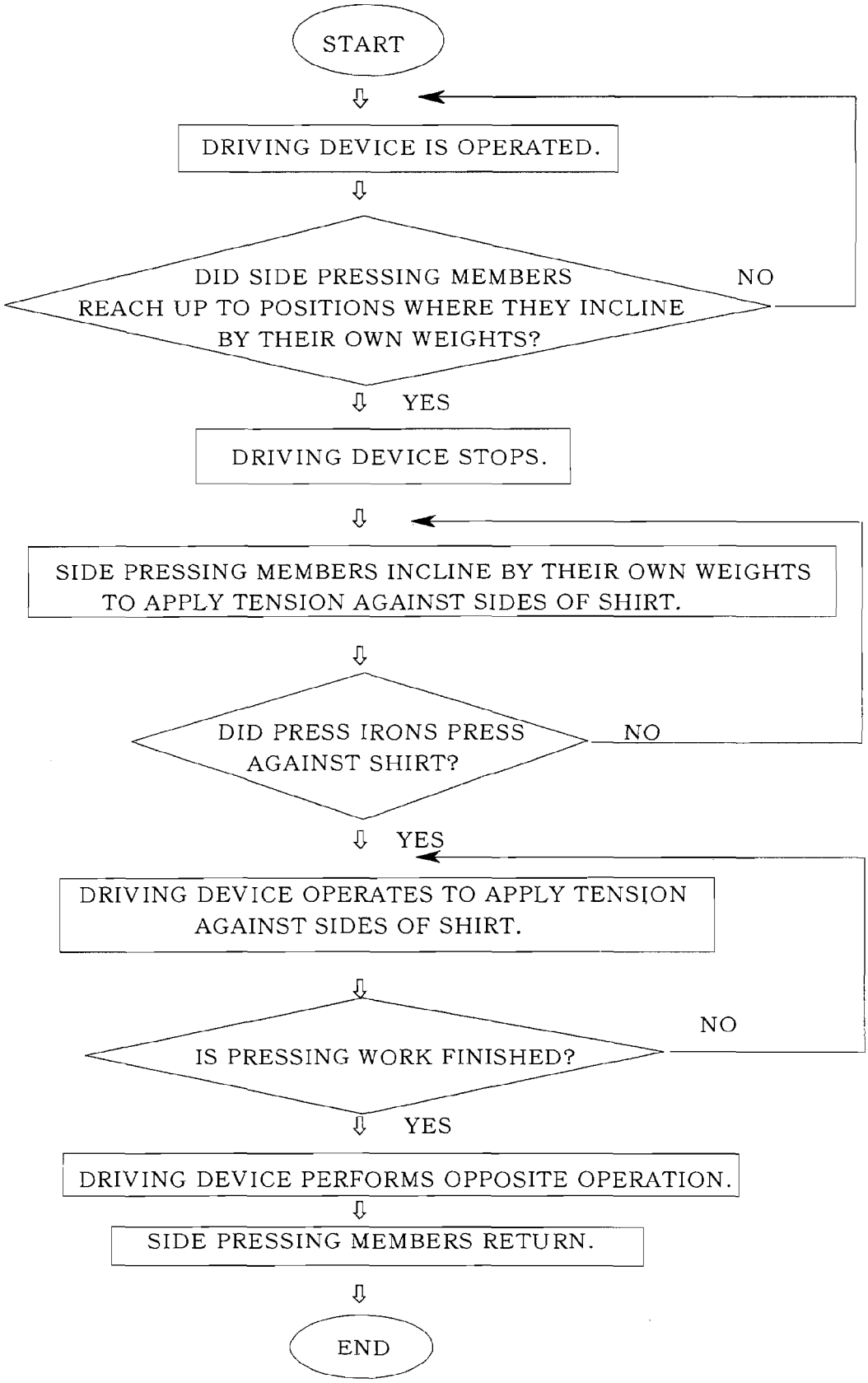
FIG. 4 is a flow-chart for illustrating an action of the present invention.

Referring now to FIG. 4 and the like, an action of the present invention in accordance with the preferred embodiment will be described.

At first, an operator turns on a starting switch 14 (refer to FIG. 2) under a state in which the shirt 1 is set on the dummy 2. Then, the solenoid valve 13 receives a signal from the controller 7 to open the air flow passage, and the air cylinder acting as the driving device 4 pushes the lower end of a bent part 5*a* of supporting member 5 into the dummy 2. As a result, the supporting member 5 is pivoted around a shaft 11 to the side part of the dummy 2.

Then, upon elapsing the set time, the driving operation of the air cylinder acting as the driving device 4 stops and a motion of the rod becomes free. The set time is a time in which the side pressing members 3 can be arranged at positions where they may incline by their own weight.

Accordingly, in the case of the present invention, upon elapsing of the set time, the side pressing members 3 are arranged at the positions where they incline (refer to A in FIG. 1) by their own weight as shown in FIG. 1. Then, upon arrangement of the side pressing members 3 at these positions, the side pressing members 3 incline by their own weight toward the side portions of the dummy 2 to apply tension against the side portions of the shirt 1 (refer to B in FIG. 1). More practically, wire members 3*a* tensioned at the side pressing members 3 are pushed against the side inner surfaces of the shirt 1 to cause the side portions of the shirt 1 to be tensioned at the side portions of the dummy 2 while they are flexed along the inner curved lines of the shirt 1.

Then, when a pair of front and rear press irons 6 (refer to FIG. 2) press against the front and rear portions of the shirt 1, a signal from the controller 7 is received at the solenoid valve 13 and the solenoid valve 13 is operated again to cause the rod of the air cylinder to be slightly extended. With this operation, the side portions of the shirt 1 are further tensioned and the second tension applying process is carried out (refer to C in FIG. 1). Further, in the case of this preferred embodiment, the front and rear press irons 6 move from the right side escaping position at the dummy 2 toward the front side of the dummy 2 to press against the shirt 1.

Then, upon completion of the press work performed by the press irons 6, the signal from the controller 7 is received at the solenoid valve 13 to cause the air flow passage to be changed over and the rod of the air cylinder acting as the driving device 4 is retracted. As a result, the supporting members 5 are turned around the shafts 11 toward the side portions of the dummy 2 and then the side pressing members 3 return.

Figure 5:
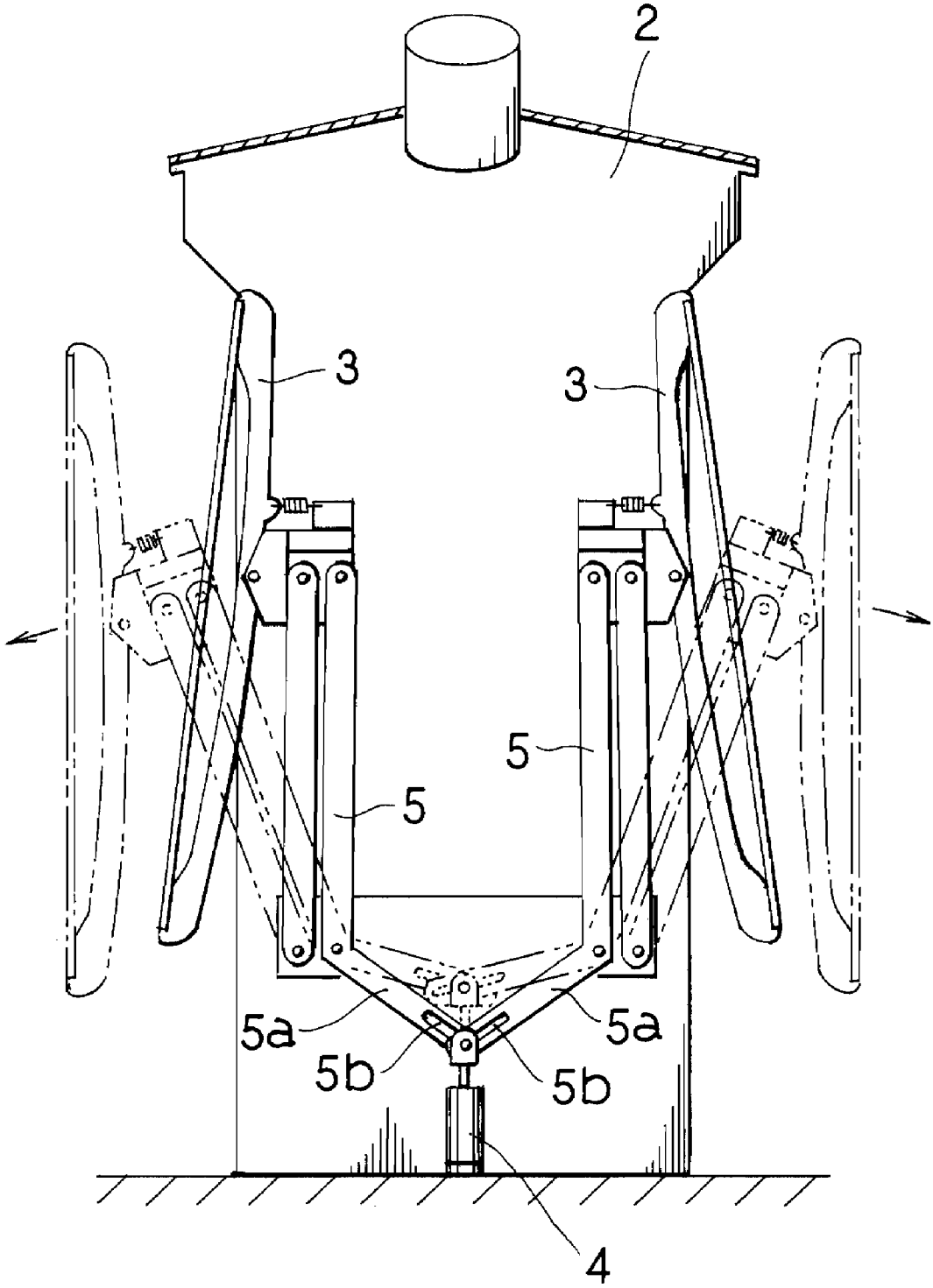
FIG. 5 is a substantial longitudinal view in section for showing another preferred embodiment of the present invention.

With the foregoing arrangement, although the air cylinder acting as the driving device 4 in the above example is separately arranged at the side pressing members 3 at both sides of the dummy 2, the present invention is not limited to this embodiment. That is, as shown in FIG. 5, it is also applicable in the present invention that the air cylinder acting as the driving device 4 is arranged to be raised at the central part of the lower portion of the dummy 2 in a lateral direction with its rod being set upright and the right and left side pressing members 3 are operated simultaneously by this one unit of driving device 4. Because, in accordance with the present invention, one unit of air cylinder is satisfactory for the operation to enable parts cost and manufacturing cost to be reduced. In this case, each of the bent parts 5*a* of the supporting members 5 is formed with a longitudinal hole 5*b*, the rod of the air cylinder is pivoted at the bent parts 5*a* through the longitudinal holes 5*b*.

Figure 6:
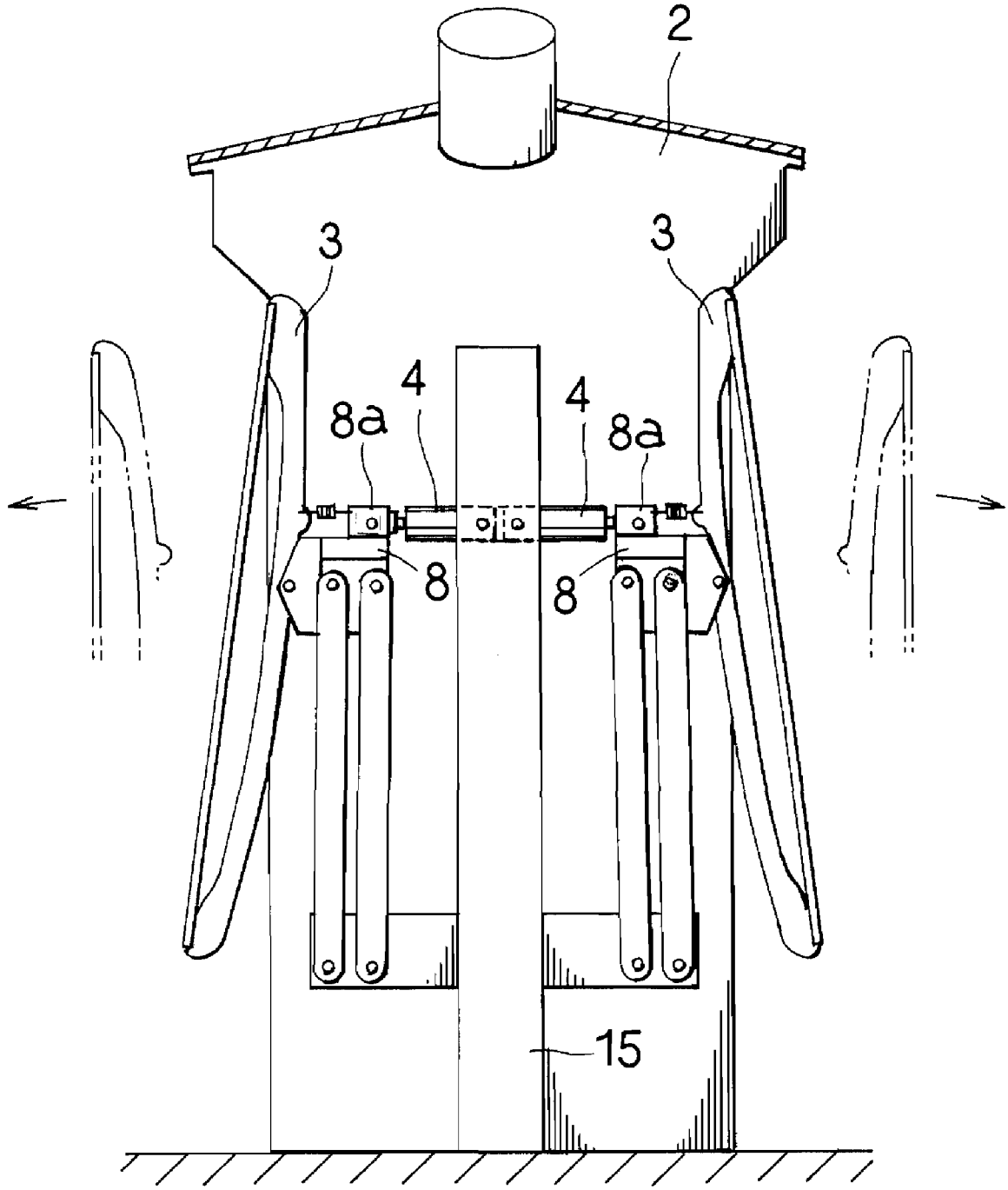
FIG. 6 is a substantial longitudinal view in section for showing a still another preferred embodiment of the present invention.

In addition, as shown in FIG. 6, it is also preferable in the present invention that a pair of right and left air cylinders acting as the driving device 4 are arranged laterally within the barrel of the dummy 2 with the rods being faced to the side portions of the dummy 2. Reference numeral 15 denotes a supporting column for use in fixing the driving device 4. The rods of the air cylinders acting as the driving device 4 are pivotally arranged at the raised pieces 8*a* of the connecting plates 8. In this case, since the air cylinders are operated near the side pressing members 3 to enable the side pressing members 3 to work, it becomes possible to use a less-expensive air cylinder having a low capability. In addition, in this case, since the arrangement position of the driving device 4 is high, no disturbance of hot air and steam supplied into the dummy 2 from below occurs as compared with that of arrangement of the driving device 4 at the lower part of the dummy 2. Accordingly, in accordance with the present invention, the shirt 1 can be dried smoothly and fast and its finished state can be made superior.

The invention claimed is:

1. A shirt side tension applying method for finishing side portions of a shirt comprising the steps of providing a first tension applying process in which side pressing members arranged lengthways at both side portions of a dummy having the shirt put thereon are extended up to position where the side pressing members incline by their own weight at the side portions of the dummy by a driving device for use in tensioning the side pressing members and the side portions of the shirt are tensioned with the side pressing members inclined by their own weight in compliance with the size of the shirt, and providing a second tension applying process in which, when front and rear portions of the shirt are pressed, the same driving device is operated again to cause the side pressing members to be further extended and the side portions of the shirt are finished in tension.

2. A body tensioning device for finishing side portions of a shirt comprising a set of side pressing members arranged lengthways at both side portions of a dummy having a shirt put thereon, a driving device for initially extending the side pressing members up to a first tension applying position where the side pressing members incline by their own weight at the side portions of the dummy such that the side portions of the shirt are tensioned with the side pressing members inclined by their own weight, and then, when front and rear portions of the shirt are pressed, the same driving device further extends the side pressing members to a second tension applying position so that the side portions of the shirt are finished in tension, and a controller for controlling the driving device to cause the side pressing members to move sequentially to the first tension applying position and the second tension applying position.

3. The body tensioning device according to claim 2, wherein the driving device is arranged inside a lower part of the dummy.

4. The body tensioning device according to claim 3, wherein lower portions of raised supporting members for supporting the side pressing members have parts bent from the positions of pivoted shafts for the supporting members toward the inside of the dummy, and a rod of an air cylinder acting as the driving device is pivoted at lower ends of the bent parts.

5. The body tensioning device according to claim 4, wherein one unit of the air cylinder acting as the driving device is installed in a raised state at a central part in a lateral direction of the lower part of the dummy with the rod of the air cylinder being upright.

6. The body tensioning device according to claim 2, wherein the driving device is an air cylinder and a pair of right and left air cylinders are arranged within a barrel of the dummy with rods of the air cylinders being faced laterally toward the side portions of the dummy.

* * * * *